US006171147B1

(12) United States Patent
Nachbauer et al.

(10) Patent No.: US 6,171,147 B1
(45) Date of Patent: Jan. 9, 2001

(54) COUPLING ELEMENT FOR AN ELECTRICAL CABLE

(75) Inventors: Otto Nachbauer, Floss; Thomas Jakob, Weiden, both of (DE)

(73) Assignee: Alcatel, Paris (FR)

( * ) Notice: Under 35 U.S.C. 154(b), the term of this patent shall be extended for 0 days.

(21) Appl. No.: 09/179,333

(22) Filed: Oct. 27, 1998

(30) Foreign Application Priority Data

Oct. 30, 1997 (DE) ..... 197 48 044

(51) Int. Cl.[7] ..... H01R 13/58
(52) U.S. Cl. ..... 439/604
(58) Field of Search ..... 439/578, 579, 439/580–585, 686, 936, 604

(56) References Cited

U.S. PATENT DOCUMENTS

| | | | | |
|---|---|---|---|---|
| 2,833,998 | * | 5/1958 | Alden | 439/604 |
| 3,744,128 | | 7/1973 | Fisher et al. . | |
| 4,896,000 | | 1/1990 | Proctor et al. . | |
| 5,435,757 | * | 7/1995 | Fedder et al. | 439/686 |
| 5,733,145 | * | 3/1998 | Wood | 439/604 |

FOREIGN PATENT DOCUMENTS

| | | |
|---|---|---|
| 10 50 853 | 11/1950 | (DE) . |
| 81 28 687 | 10/1981 | (DE) . |
| 90 01 191 | 5/1990 | (DE) . |
| 40 38 756 | 12/1990 | (DE) . |
| 94 10 092 | 9/1994 | (DE) . |
| 195 11 056 | 10/1995 | (DE) . |
| 25 37 793 | 6/1984 | (FR) . |

* cited by examiner

*Primary Examiner*—Khiem Nguyen
*Assistant Examiner*—J. F. Dugerne
(74) *Attorney, Agent, or Firm*—Ware, Fressola, Van der Sluys & Adolphson LLP

(57) ABSTRACT

A coupling element is proposed for a single wire or multi-wire electrical cable. The coupling element has a contact support to which a protective body surrounding the cable connection is molded in such a way that a region of the surface of the contact support remains exposed. The exposed region (4) has openings (7) extending through the contact support and contacts that are conductively connected with a wire of the cable (1) and arranged in the openings. A closed cover (8) is provided in close contact with the contact support (2) and extends over the openings (7). The cover (8) is provided with a passage (9) having the edges surrounding and fitting tightly against the cable (1). The protective body (6) surrounds the cover (8) and the passage (9) and is in moisture-tight sealing engagement with the contact support (2) and the cable (1). A method for producing the coupling element provides for molding the protective body (6) so it surrounds the cover (8).

10 Claims, 2 Drawing Sheets

COUPLING ELEMENT FOR AN ELECTRICAL CABLE

BACKGROUND OF THE INVENTION

1. Technical Field

The invention related to a coupling element for a single wire or multi-wire electrical cable and a method of producing the same. The coupling element comprises a contact support to which a protective body surrounding the cable connection is molded in such a way that a region of the surface of the contact support remains exposed. The exposed region has openings extending through the contact support and contacts that are conductively connected with a wire of the cable arranged in the openings.

2. Description of the Related Art

Coupling elements, which can include pin-type connectors as well as female receptacles, are generally used to connect multi-wire electrical cable in the automobile industry. Such connectors provide, for example, a connection between the anti-lock braking system (ABS) or the electrical braking system (EBS) of a trailer and the tractor. If the cables between the vehicles are exposed, then the coupling elements are exposed to dirt, splash water, shock and tensile loads. It is therefore advantageous to use a mechanically robust construction that protects against moisture and dirt.

The utility model DE 94 10 092 discloses a coupling element wherein a protective body is molded to the contact support holding the electrical contacts in place. The protective body surrounds the cable or at least the section of the cable in which the jacket has been removed to electrically connect to the contacts, and also the marginal edge of the jacket. The protective body thereby forms a mechanical protection for the contact support as well as a strain relief for the cable while simultaneously sealing the cable. The contacts have to remain free of the molding material in order to provide a reliable connection with close tolerances between the coupling element and a mating element.

The region of the contact support in which the contacts are arranged, has a predetermined shape and can comprise raised portions, recesses or guides to connect to and lock with the mating element. The edge region of the contact support is typically sealed by a circumferential seal that is arranged, for example, in a groove disposed on the front face of the contact support. During operation, the coupling element is engaged with a complementary mating element that closes the seal. With this arrangement, dirt cannot accumulate in the contact region, and moisture is prevented from entering the coupling element along the contacts. Although it would be possible to seal only the individual contacts against the liquid molding material, it is preferred to keep the entire region near the seal and the contacts free of molding material to ensure a precise fit with the mating element.

It is difficult to seal the openings of the contact support in the area of the contacts. The contacts are typically inserted into and secured in the openings with a locking element. The contacts frequently have recesses or a shape that is not complementary to the cross-section of the opening. Consequently, the seal is not tight. To prevent the molding material from penetrating the openings when the protective body is formed, the DE-GM 94 10 092 proposes to hermetically seal the openings individually with separate sealing elements. Alternatively or in addition, a hot melt adhesive can also be used to form the seal.

Disadvantageously, however, sealing the openings is very labor intensive, with the costs increasing for multi-wire cables according to the number of wires. Also, the fabrication of the protective body of conventional couplings requires a comparatively large amount of molding material which raises the weight and the production costs.

SUMMARY OF THE INVENTION

With the foregoing in mind, it is an object of the invention to develop a coupling element with a molded protective body that can be fabricated at low cost.

In a primary aspect of the invention, a common cover is provided for the openings. The cover fits tightly against the contact support and extends over the openings of the contact support. The cover thereby prevents liquid molding material that after hardening forms the protective body, from gaining entry. The contacts with the attached wires are preferably inserted from the rear and thereby completely recessed. Moreover, the cover has to include a passage for the cable. The cable jacket fits tightly against the circumferential edges of the passage, and the cable is divided into the individual wires that are connected to the contacts, only inside the cover. Since the cable jacket has only one seal, the coupling element can be more easily manufactured, in particular for multi-wire cables, since not every wire has to be individually sealed.

The protective body is manufactured by injection molding it around the cover and surrounds the cover completely or at least partially. The protective body also surrounds the cable in the region of the passage. A portion of the contact support is surrounded by the protective body or at least borders the protective body. By using a suitable molding tool, a region of the surface of the contact support can be kept free of the molding material. Sometimes, the exposed region includes only the openings and therefore includes several parts; preferably, however, the exposed region is contiguous.

The contact support is made of a relatively rigid insulating material, e.g. a plastic such as polyamide, to provide a tight-fitting, reliable and mechanically strong connection with a mating element of the coupling element. The protective body, however, is preferably made of a relatively soft plastic, e.g. a thermoplastic elastomer (TPE), and forms a protective shock-absorber for the contact support and the cover. Moreover, a soft protective body adheres better to a flexible cable that is frequently subjected to tensile and bending stress. The cable jacket is also made of a relatively soft material, such as polyurethane, e.g. thermoplastic Elastolan.

Advantageously, the proposed coupling element is mechanically strong and provides a reliable strain relief and water seal of the cable connection. The coupling element can also be manufactured at significantly lower costs than conventional coupling elements. The empty space remaining inside the coupling element under the cover reduces the weight and the material costs even further.

The boundary surface between the protective body and the cover is frequently significantly larger than the boundary surface between the protective cover and the contact support. This improves the adhesion between the cover and the protective body forming the strain relief of the cable. However, the force to the element mating with the coupling element is transmitted exclusively through the contact support. The protective body can be prevented from separating when the coupling is subjected to a mechanical load by locking the contact support with the cover together, i.e. by providing a rigid connection between the contact support and the cover.

Advantageously, the connection is of the interlocking type. Suitable components are latching elements, such as raised portions or barbs, disposed on the contact support or the cover and engaging a recess or a projection of the respective other component. With a sufficiently resilient material, the resilient restoring force produced by the deformation of the components can provide adequate latching. The contact support can be connected reliably, easily and fast by attaching or inserting the cover. This connection cannot be disengaged after the protective body is molded. The protective body can also provide the latching connection by catching behind sections of the contact support and the cover.

Alternatively or in addition, a locking connection can be provided by carefully matching the materials for the contact support, the cover and the protective body. These materials then adhere to each other when the protective body is molded. For example, the materials can react with each other chemically or can melt together near the surface.

To reliably seal against the pressurized molding material of the protective body, the corresponding contact area of contact support and cover is preferably formed from mutually parallel walls. The walls can be arranged side by side, making contact across a certain area. The walls can also include circumferential ribs, with the ribs contacting the respective other wall. The parallel arrangement of the walls produces an extended sealing area. This arrangement prevents the molding material from penetrating under the cover even in the event that the molding material gain entry into the marginal regions of the sealing surface.

A reliable seal between the cover and the contact support can also be achieved if one of the components has a circumferential groove, with the marginal edges of the respective other component slideably inserted into the groove. This feature fixes the position of the cover and increases the length of the path the liquid molding material has to travel before it can penetrate the seal.

If the walls that form a sealing surface between the cover and the contact support, are in contact with each other, then the wall making contact on the outside has preferably a greater flexibility that the wall on the inside. The pressure of the molding material presses the walls against each other when the protective body is formed, thereby improving the sealing action. The same applies if the cover and the contact support are in engagement via a groove. The component inserted into the groove then forms the outer wall while the inside boundary of the groove forms the inner wall. The flexibility of the walls can vary, either because different materials are employed or by appropriately shaping the material, in particular if the cover and the contact support are made of the same material. In the latter case, the cover advantageously forms the outer wall. The components can be designed to deform slightly, e.g. by elongating the cover in the direction of the cable. The shape of the inner wall can be made more stable by providing reinforcing ribs or other support elements. For example, the inner wall can be formed by the outer surfaces of the center region of the contact support in which the openings for receiving the contacts are arranged.

The passage for covering the cable is preferably a tubular shaft which is provided with an essentially cylindrical inner surface extending in the axial direction. This design seals reliably across an extended sealing surface between the cover and the cable. On the outside, the tubular shaft advantageously projects over the cover.

In an advantageous embodiment, the coupling element can include, for example, a protruding passage in the form of a shaft, with the protective body having two sections separated by a gap. One section encloses the cable and the edge of the passage facing away from the contact support; this section forms the seal and the strain relief for the cable end. The other section abuts the contact support and surrounds the cover, thereby preventing moisture from gaining entry into the interior of the connector. The other section frequently forms the larger portion of the outer surface of the coupling element. Because of the gap between the two sections, radial pressure can be applied to the cover when the protective body is molded. During the molding process, the passage is pressed onto the cable and/or the cover is pressed against the contact support, providing a reliable seal.

It an advantageous method for fabricating a coupling element, contacts are first connected to the wires of a cable and inserted into the openings of a contact support. A cover with a passage for the cable has either already been pushed onto the cable jacket or is now being pushed onto the cable jacket. The cover is placed liquid-tight on the contact support and, if necessary, locked. The contact support together with the cover is inserted in a molding tool to separate the region of the openings of the contact support liquid-tight from the plastic inlet of the molding tool. The cover is subsequently extruded in the molding tool with a plastic material to form the protective body of the coupling element.

In a preferred embodiment of the method, the molding tool is pressed against the walls of the cover, with the inner surfaces of the cover forming a sealing surface to the cable or the contact support. The contact pressure is high enough to deform the cover and to close the cavities to the cable jacket and the contact support, respectively. The cover is preferably provided with a passage in the form of a shaft. During the molding process, elements of the molding tool can be pressed against the shaft. The protective body produced in this manner is comprised of elements that are separated by a gap, or has at least recesses that are caused by the pressure exerted on the cover by the components of the tool.

The invention will be fully understood when reference is made to the following detailed description taken in conjunction with the accompanying drawings.

DETAILED DESCRIPTION OF THE INVENTION

Figure 1:
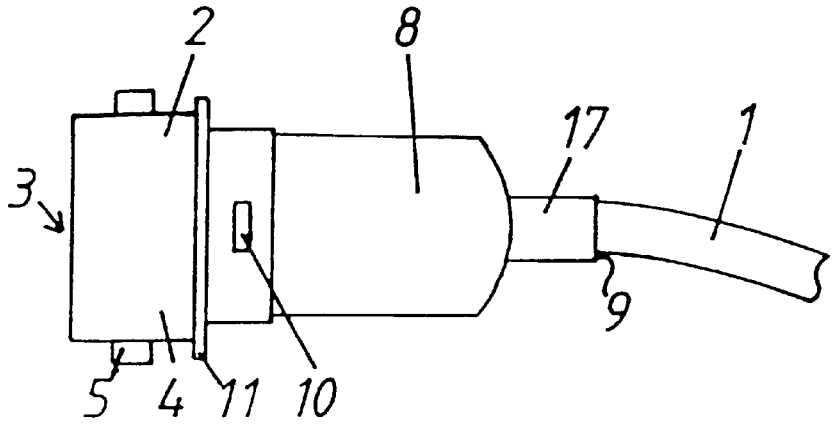
FIG. 1 is a side view of a coupling element before the protective body is applied.

The coupling element operates to connect an electrical cable 1) having wires connected to contacts, with the contacts inserted in a contact support 2. The region 4 of the coupling element adjacent to the front side 3 of the contact support 2 has a predetermined form and is adapted to be inserted in a mating element (not shown). In particular, the outer contours of the region 4 and the arrangement of the contacts are predetermined; also arranged in this region are connecting or guide means, such as pins 5, cooperating with complementary components of the mating element and forming a locking connection. On the other hand, the rear side of the coupling element in a region of the cable connection can have different designs. This region of the coupling element is typically formed by a protective body 6 that is molded to the contact support 2 and surrounds an end of the cable 1.

To ensure a precise fit with the mating element, the region 4 has to remain free of molding material when the protective body 6 is molded. One problem is caused in particular by the openings 7 in the contact support 2 which connect the front side 3 of the contact support 2 with the cable 1 and receive the contacts. To provide a seal, a cover 8 that completely seals against the molding material, is placed on the rear side of the contact support 2. The cover 8 has a passage 9 through which the cable 1 passes into the interior space. The cable 1 is also sealed at the same time. All contacts in the contact support 2 can thereby be connected with the wires of the cable 1, without requiring a separate seal for each opening 7. The cover 8 can be latched with the contact support 2 with a latching element 10, for example a hook. A circumferential raised portion 11 of the contact support 2 separates the extruded region of the coupling element from its exposed region 4.

Figure 2:
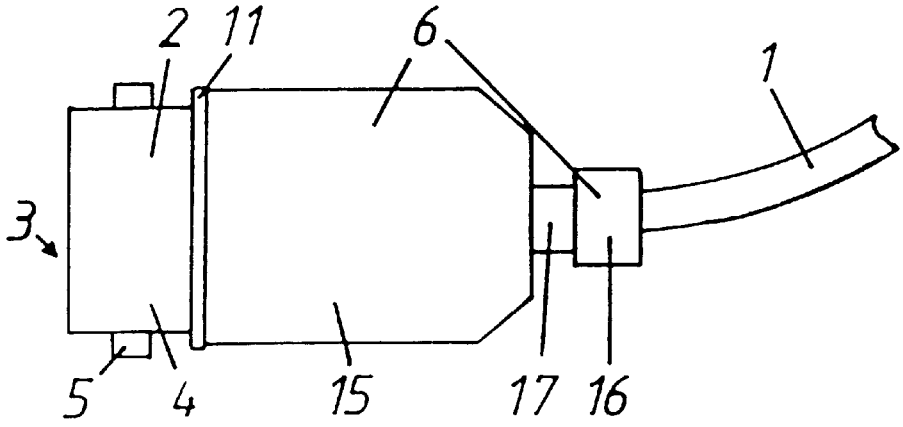
FIG. 2 is a side view of a coupling element with the protective body.

As seen in FIG. 2, the protective body 6 has two sections 15, 16 which are separated by a gap. The sections are connected only by a shaft 17 disposed at the end of the cover 8 and surrounding the passage 9. Consequently, the radial pressure produced when the protective body 6 is molded can reduce the diameter of the shaft 17. The molding material is then not able to gain entry to the inside of the cover 8 through the passage 9. The section 15 predominantly provides a liquid-tight seal of the gap between the contact support 2 and the cover 8 and forms the outer gripping surface for manipulating of the coupling element. The section 16 forms a strain relief for the cable 1 and seals the passage 9.

Figure 3:
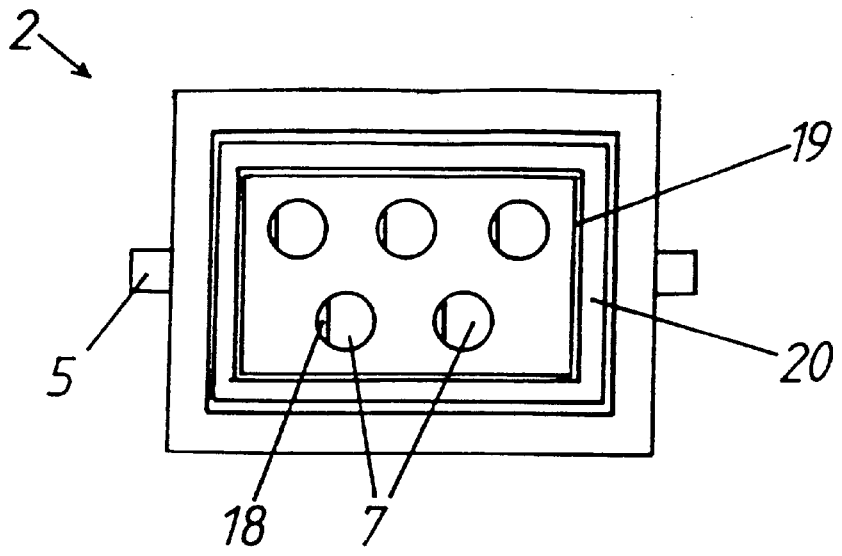
FIG. 3 is a rear view of the contact support of the coupling element.

FIG. 3 illustrates a view of the rear side of the contact support 2 facing the cable 1 on which the cover 8 is placed. The openings 7 that connect the rear side to the front side 3 and into which the contacts can be inserted, are disposed in the center of the contact support 2. The contacts can be latched via ribs 18 located in the openings 7. The openings 7 are surrounded by an inner wall 19 that projects from the surface of the contact support 2 in a direction perpendicular to the figure plane. The cover 8 can be pushed onto the outside of the wall 19 and provides a tight seal against the molding material. To provide an even better seal, the wall 19 is surrounded by a groove 20 into which the edge of the cover 8 can be inserted.

Figure 4:
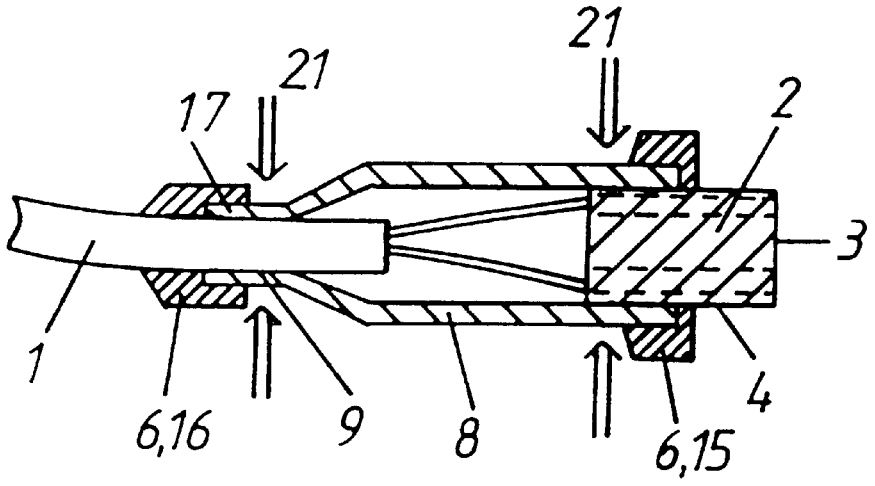
FIG. 4 is a cross-sectional view through an alternative coupling element.

FIG. 4 shows a cross-section through another embodiment of the coupling element wherein the gap between the sections 15, 16 of the protective body 6 is relatively large. The seal between the contact support 2 and the cover 8 can be improved by pressing the contact support 2 and the cover 8 against each other in the molding tool. Preferably, a pressure in the direction of an arrow 21 is applied to the locations marked with the arrow 21. Only the section 15 of the protective body 6 provides here the locking connection between the contact support 2 and the cover 8. During the molding process, the section 15 connects both components so that they can withstand a large load.

As a result, a coupling element can be formed that is protected against moisture and can withstand tensile loads and that can be manufactured by a simple method and at low costs.

The embodiments described above admirably achieve the objects of the invention. However, it will be appreciated that departures can be made by those skilled in the art without departing from the spirit and scope of the invention which is limited only by the following claims.

What is claimed is:

1. Coupling element for a single wire or multi-wire electrical cable, wherein the coupling element comprises:

(a) a contact support having an exposed region, the exposed region has openings extending through the contact support;

(b) contacts conductively connected with a wire of the cable and arranged in the openings, the contacts and openings have noncomplementary shapes whereby the contacts fit in the contact support defining the openings in a nonsealing relationship;

(c) a closed cover in a close contact with the contact support and extending over the openings, the cover being provided with a passage having edges surrounding and fitting tightly against the cable;

(d) a molded protective body surrounding the cover and the passage, but leaving the exposed region of the contact support uncovered, the protective body being in moisture-tight sealing engagement with the contact support and the cable.

2. Coupling element according to claim 1, wherein the contact support and the cover are operatively connected.

3. Coupling element according to claim 2, wherein the contact support and the cover are in locking engagement.

4. Coupling element according to claim 3, wherein the protective body is in locking engagement across a boundary surface to the contact support and the cover.

5. Coupling element according to claim 2, wherein the protective body is in locking engagement across a boundary surface to the contact support and the cover.

6. Coupling element according to claim 1, wherein the contact support and the cover are arranged with abutting parallel aligned walls.

7. Coupling element according to claim 1, wherein the cover and the contact support have a sealing surface with an inner wall and an outer wall, the outer wall having a greater flexibility than the inner wall.

8. Coupling element according to claim 1, wherein one of the cover and the contact support has a circumferential groove and the other of the cover and the contact has an edge which engages the circumferential groove.

9. Coupling element according to claim 1, wherein the passage is a tubular shaft projecting over the cover.

10. Coupling element according to claim 1, wherein the protective body comprises two spaced-apart elements, with one of the elements surrounding the cable and an outer edge of the passage.

* * * * *

UNITED STATES PATENT AND TRADEMARK OFFICE

CERTIFICATE OF CORRECTION

PATENT NO. : 6,171,147 B1
DATED : January 9, 2001
INVENTOR(S) : Otto Nachbauer and Thomas Jakob It is certified that error appears in the above-identified patent and that said Letters Patent is hereby corrected as shown below:

Title page,
"FOREIGN PATENT DOCUMENTS", add the following reference:
-- 40 13 509 10/1991 (DE) --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*